US009033410B2

(12) United States Patent
Roani et al.

(10) Patent No.: US 9,033,410 B2
(45) Date of Patent: May 19, 2015

(54) FOLDING CHAIR

(75) Inventors: Corrado Roani, Manthes (FR); Jean-Noël Pernet, Condamine la Doye (FR)

(73) Assignee: LAFUMA MOBILIER S.A.S., Anneyron (FR)

( * ) Notice: Subject to any disclaimer, the term of this patent is extended or adjusted under 35 U.S.C. 154(b) by 0 days.

(21) Appl. No.: 14/003,825

(22) PCT Filed: Feb. 15, 2012

(86) PCT No.: PCT/FR2012/050325

§ 371 (c)(1),
(2), (4) Date: Oct. 9, 2013

(87) PCT Pub. No.: WO2012/120212

PCT Pub. Date: Sep. 13, 2012

(65) Prior Publication Data

US 2014/0021749 A1 Jan. 23, 2014

(30) Foreign Application Priority Data

Mar. 7, 2011 (FR) ..... 11 51829

(51) Int. Cl.

| | |
|---|---|
| ***A47C 4/28*** | (2006.01) |
| ***A47C 4/30*** | (2006.01) |
| ***A47C 5/10*** | (2006.01) |

(Continued)

(52) U.S. Cl.

CPC ... *A47C 4/28* (2013.01); *A47C 5/10* (2013.01); *A47C 4/30* (2013.01); *A47C 1/14* (2013.01); *A47C 1/143* (2013.01); *A47C 4/50* (2013.01)

(58) Field of Classification Search

CPC ..... A47C 4/28; A47C 4/30; A47C 5/10
USPC ..... 297/16.1, 24, 25, 26, 55, 56, 452.13, 297/452.2

See application file for complete search history.

(56) References Cited

U.S. PATENT DOCUMENTS

| | | | | | |
|---|---|---|---|---|---|
| 1,209,679 | A | * | 12/1916 | Decker | 5/116 |
| 2,691,410 | A | * | 10/1954 | Boucher | 297/45 |
| 2,738,001 | A | * | 3/1956 | Drabert | 297/328 |

(Continued)

FOREIGN PATENT DOCUMENTS

| | | |
|---|---|---|
| BR | 6700348 U | 7/1987 |
| DE | 295 16 007 U1 | 1/1996 |

(Continued)

OTHER PUBLICATIONS

May 4, 2012 Search Report issued in International Patent Application No. PCT/FR2012/050325 (with translation).

*Primary Examiner* — Ryan Kwiecinski
(74) *Attorney, Agent, or Firm* — Oliff PLC

(57) ABSTRACT

A folding chair capable of being moved between a folded position and an unfolded position, includes: two units, each of which includes first and second tubes hinged together via a hinge pin; and a canvas sheet, where each assembly of two tubes includes a rigid part at the hinge pin thereof, said rigid part being arranged between two tubes and having: a groove for receiving a tube of the assembly without any degree of freedom; first and second cradles arranged on either side of the hinge pin, such that when the chair is in the unfolded position, the first cradle bears against the upper section of the other tube and the second cradle bears against the lower section of the other tube.

9 Claims, 6 Drawing Sheets

(51) Int. Cl.
*A47C 1/14* (2006.01)
*A47C 4/50* (2006.01)

(56) References Cited

U.S. PATENT DOCUMENTS

| | | | | |
|---|---|---|---|---|
| 3,138,400 | A * | 6/1964 | Reid | 297/19 |
| 3,298,537 | A * | 1/1967 | Di Marco | 211/200 |
| 4,044,931 | A * | 8/1977 | Catelli | 224/155 |
| 4,536,026 | A * | 8/1985 | Cornell | 297/39 |
| 5,054,848 | A * | 10/1991 | Liu | 297/39 |
| 5,971,474 | A * | 10/1999 | Chang | 297/56 |
| 5,975,626 | A * | 11/1999 | Aycock | 297/16.1 |
| 6,095,596 | A * | 8/2000 | Chen | 297/39 |
| 6,742,839 | B2 * | 6/2004 | Piretti | 297/239 |
| 6,752,452 | B2 * | 6/2004 | Choi et al. | 297/16.2 |
| 6,997,507 | B2 * | 2/2006 | Rhee | 297/129 |
| 7,063,380 | B1 * | 6/2006 | Cui | 297/30 |
| 7,168,580 | B2 * | 1/2007 | Larimer et al. | 211/200 |
| 7,185,948 | B2 * | 3/2007 | Liu | 297/30 |
| 7,273,249 | B1 * | 9/2007 | Tseng | 297/39 |
| 7,628,450 | B2 * | 12/2009 | Castagnola et al. | 297/38 |
| 8,056,969 | B2 * | 11/2011 | Grace et al. | 297/56 |
| D667,648 | S * | 9/2012 | Le Gal et al. | D6/361 |
| 8,322,785 | B2 * | 12/2012 | Grace et al. | 297/56 |
| D675,841 | S * | 2/2013 | Mound, II | D6/368 |
| 8,678,700 | B2 * | 3/2014 | Tsai | 403/400 |
| 2002/0125745 | A1 * | 9/2002 | Lee | 297/30 |
| 2007/0228780 | A1 * | 10/2007 | Grace | 297/45 |
| 2009/0320241 | A1 * | 12/2009 | Lazert et al. | 16/239 |
| 2011/0037297 | A1 * | 2/2011 | Lo et al. | 297/30 |
| 2012/0080909 | A1 * | 4/2012 | Grace et al. | 297/16.1 |
| 2014/0021749 | A1 * | 1/2014 | Roani et al. | 297/16.1 |

FOREIGN PATENT DOCUMENTS

| | | |
|---|---|---|
| FR | 1304459 | 9/1962 |
| GB | 821665 | 10/1959 |

* cited by examiner

11

FOLDING CHAIR

The invention relates to a folding chair.

Known folding chairs comprise a tubular structure on which a canvas sheet is mounted. The tubular structure is generally made up of two frames. Each frame comprises two side tubes, and two transverse tubes connecting said side tubes. On each side of the chair, the side tubes are mounted pivotably on one another using hinge pins. Under these conditions, the chair may be moved between a folded position, in which the frames extend substantially parallel to one another, and an unfolded position, in which the frames intersect forming an X.

Different mechanisms have already been proposed in order to keep the chair in its unfolded position. It is for example known to equip the folding chair with a lever handle in the form of a stirrup pivotably mounted on the side tubes belonging to the seatback. The lower segments of the side tubes forming the rear leg assembly are equipped with a rack. When the chair is in the unfolded position, the lever handle is received between two teeth of the rack, and locks the chair in the unfolded position.

One drawback of this type of chair is that when the chair is moved into its unfolded position, by pulling on the seat back of that chair, the lever handle frequently leaves the rack. Consequently, when a user again sits on the chair, it tilts backward. These chairs are thus not very secure. Furthermore, the lever handle is often not aesthetically pleasing, and actuating it may pinch the user's fingers.

It is thus desirable to produce a chair that can be locked in the folded position more securely.

These chairs also do not have a mechanism for locking in the folded position. Therefore, in order to prevent the chair from unfolding when it is stored in the folded position, a user cinches the two frames of the chair with a lace or strap. This operation is tedious for the user. Esthetically speaking, it is also desirable to omit these laces or straps.

In other known folding chairs, the chair is locked using link rods, or textile equivalents such as straps, connecting the side tubes in the unfolded position to form armrests.

These chairs are inconvenient in that the link rods form obstacles making it difficult to access the chair, in particular for users with reduced mobility.

The invention aims to resolve one or more of these drawbacks.

The invention thus pertains to a folding chair, which can be maneuvered between a folded position and an unfolded position, including:

- a tubular structure made up of two units each comprising first and second tubes hinged on one another by a hinge pin, the axes of the two units being coaxial, each first and second tube comprising an upper segment and a lower segment, the upper segments of the first two tubes forming a seatback and the lower segments of the first two tubes forming a front leg assembly, the upper segments of the two second tubes forming a seat bottom and the lower segments of the two second tubes forming a rear leg assembly,
- a canvas sheet mounted on the upper segments of the first tubes on the one hand, and on the upper segments of the second tubes on the other hand, characterized in that each assembly of two tubes comprises a rigid part at the hinge pin thereof, said rigid part being arranged between the two tubes, and having:

- a groove in the shape of a segment with a cylindrical surface designed to receive, with no degree of freedom, a tube of the assembly of two tubes, an orifice for the passage of the hinge pin emerging in the bottom of the groove of the central zone thereof,
- first and second cradles in the form of segments with cylindrical surfaces with the same axis and same curve radius, positioned separated from each other on either side of the hinge pin, the axis of the first and second cradles forming an angle with the axis of the groove, the first cradle being turned upward, and the second cradle being turned downward, such that when the chair is in the unfolded position:
  - the first cradle bears against the upper segment of the other tube of the assembly of two tubes, and
  - the second cradle bears against the lower segment of the other tube of the assembly of two tubes.

The part positioned at the hinge pin of two tubes performs an abutment function for the tubes in the unfolded position, i.e., in the usage position of the chair, while being very compact, which favors the general aesthetics thereof, and does not form an obstacle for a user wishing to sit on or get up from the chair.

The folding chair may also include the following features.

It is for example considered that walls of at least one cradle extend over more than half of the circumference of the tube that it is designed to receive and that the cradle is made from an elastically deformable material, such that in the unfolded position, the tube clips inside said cradle.

Under these conditions, when the chair is in the unfolded position, it is locked in that position. The chair may be moved into its unfolded position, by pulling the chair by its seatback, without causing it to fold back up.

Each piece positioned at the hinge of two tubes may comprise an elastically deformable tongue designed, when the chair is in the folded position, to cooperate with the tube against which the cradles bear in the unfolded position, so as to lock the folding chair in its unfolded position.

Under these conditions, it is no longer necessary to use a lace or strap to lock the chair in the folded position.

According to one embodiment, each part positioned at the hinge of two tubes comprises a metal framework on which two half-shells made from a plastic material are mounted.

Thus configured, the rigidity of the part is reinforced. Furthermore, using two plastic half-shells makes it possible to make the part in various colors, making the chair more attractive.

It is also considered for the metal framework to comprise a segment with a cylindrical surface extending parallel to the groove from which reinforcing tabs extend toward the first and second cradles.

Under these conditions, the rigidity of the part at the cradles is reinforced.

Lastly, it is provided that at least one of the half-shells is equipped with a window leaving the metal framework visible.

Such a configuration is advantageous in that it makes it possible to minimize the quantity of plastic used to manufacture the part. Furthermore, the metal framework being made visible, the impression of solidity of the part is increased for the user.

The invention will be better understood upon reading the following description in reference to the appended diagrammatic drawings showing, as a non-limiting example, one embodiment of a folding chair according to the invention.

In the continuation of this description, the terms "top", "bottom", "front", and "rear" are defined relative to an unfolded position of the chair according to the invention.

Figure 1:
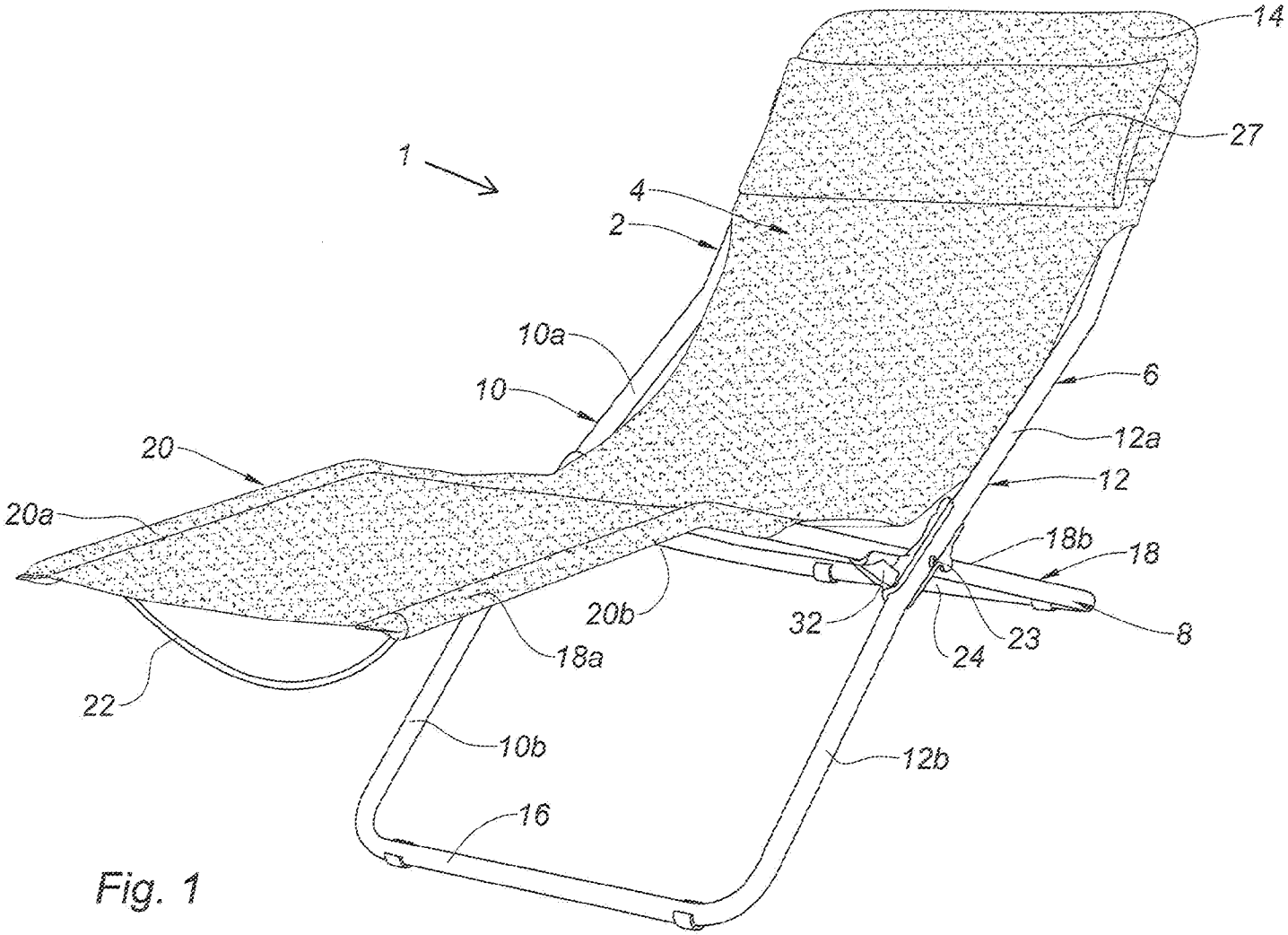
FIG. 1 is a perspective three-quarters front view in the unfolded position.

FIG. 1 illustrates a folding chair 1. The chair 1 is made up of a tubular structure 2 on which a canvas sheet 4 is mounted.

The tubular structure 2 comprises two frames 6 and 8.

The frame 6 is formed by two side tubes 10 and 12, and two transverse tubes 14 and 16 connecting those side tubes 10 and 12 at the ends thereof.

The frame 8 is made up of two side tubes 18 and 20, and two transverse tubes 22 and 24 connecting the side tubes 18 and 20. In the illustrated example, the transverse tube 22 is advantageously downwardly cinched so that when a user sits in the chair 1, his calves do not bear against the transverse tubes 22.

The tubes 10, 12, 18 and 20 respectively comprise upper segments 10*a*, 12*a*, 18*a*, 20*a* and lower segments 10*b*, 12*b*, 18*b* and 20*b*.

The lower segments 10*b*, 12*b* and the transverse tube 16 form a front leg assembly. The lower segments 20*b*, 18*b* and the transverse tube 24 form a rear leg assembly. The upper segments 18*a* and 20*a* and the transverse tube 22 formed a seat bottom. The upper segments 10*a* and 12*a* and the transverse tube 14 form a seat back.

The frames 6 and 8 are hinged using two hinge pins 23 and 25. More specifically, the hinge pins 23 and 25 respectively hinge the tube 18 on the tube 12, and the tube 20 on the tube 10. The axes of 23 and 25 are coaxial.

Under these conditions, the chair 1 is movably mounted between an unfolded position, in which the frames 6, 8 intersect and substantially form an X, and a folded position, in which the frames 6, 8 extend substantially parallel to each other.

The canvas sheet 4 is mounted on the upper segments 10*a*, 12*a* of the seat back on the one hand, and on the upper segments 18*a*, 20*a* of the seat bottom on the other hand. To that end, the canvas sheet 4 comprises a rebate inside which the transverse tube 14 and part of the upper segments 10*a* and 12*a* are received. The canvas sheet 4 comprises sleeves inside which the upper segments 18*a* and 20*a* are partially received.

In the illustrated embodiment, the chair 1 includes a headrest 27 fastened on the canvas sheet 4 at the upper segments 10*a* and 12*a*.

The chair 1 includes rigid parts 30 and 32 positioned at the hinge pins 23 and 25. The parts 30 and 32 are respectively positioned between the tubes 10, 20, and between the tubes 12, 18.

Figure 4:
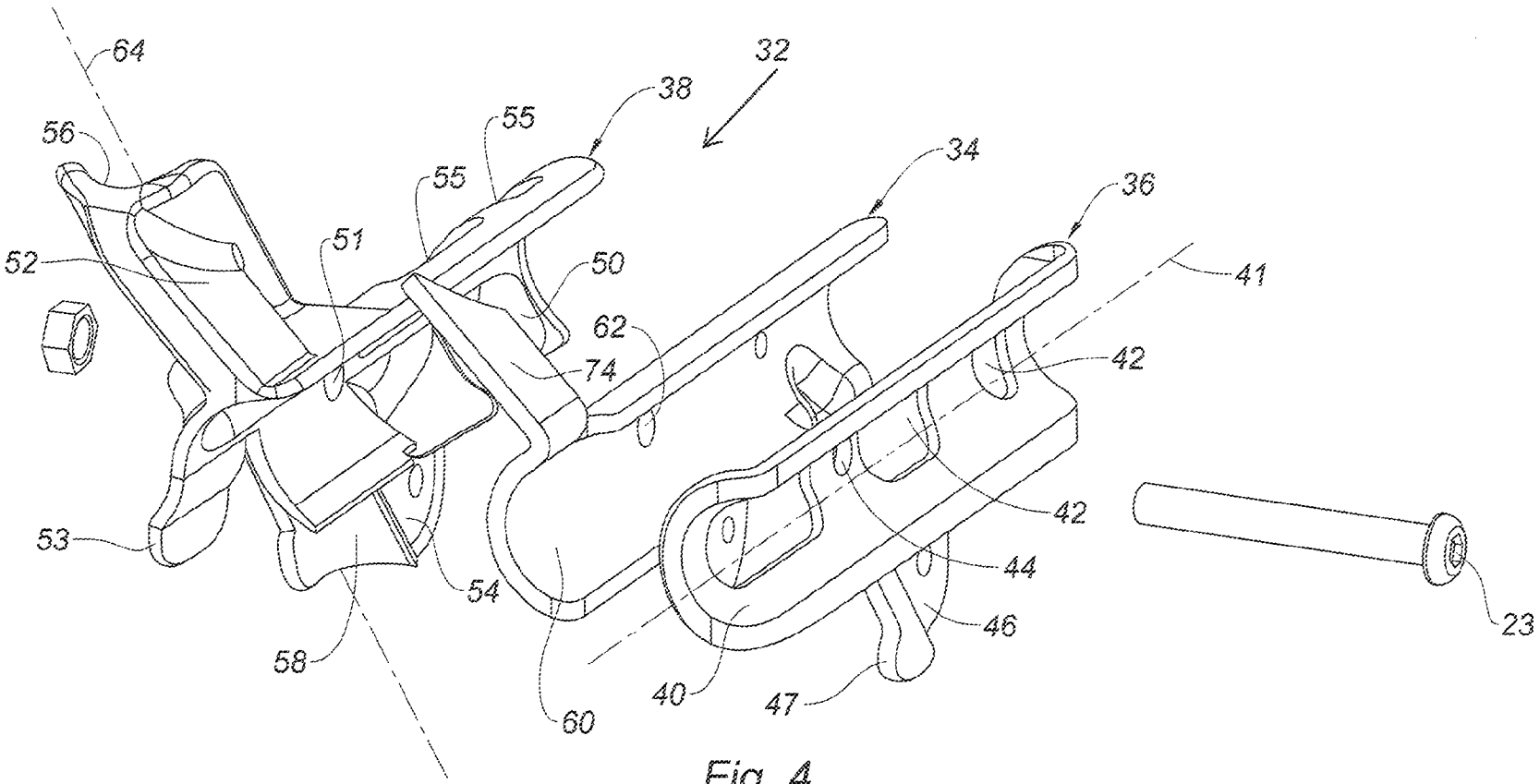
FIG. 4 is a first exploded perspective view of a part positioned at the hinge of two tubes of the chair.
Figure 5:
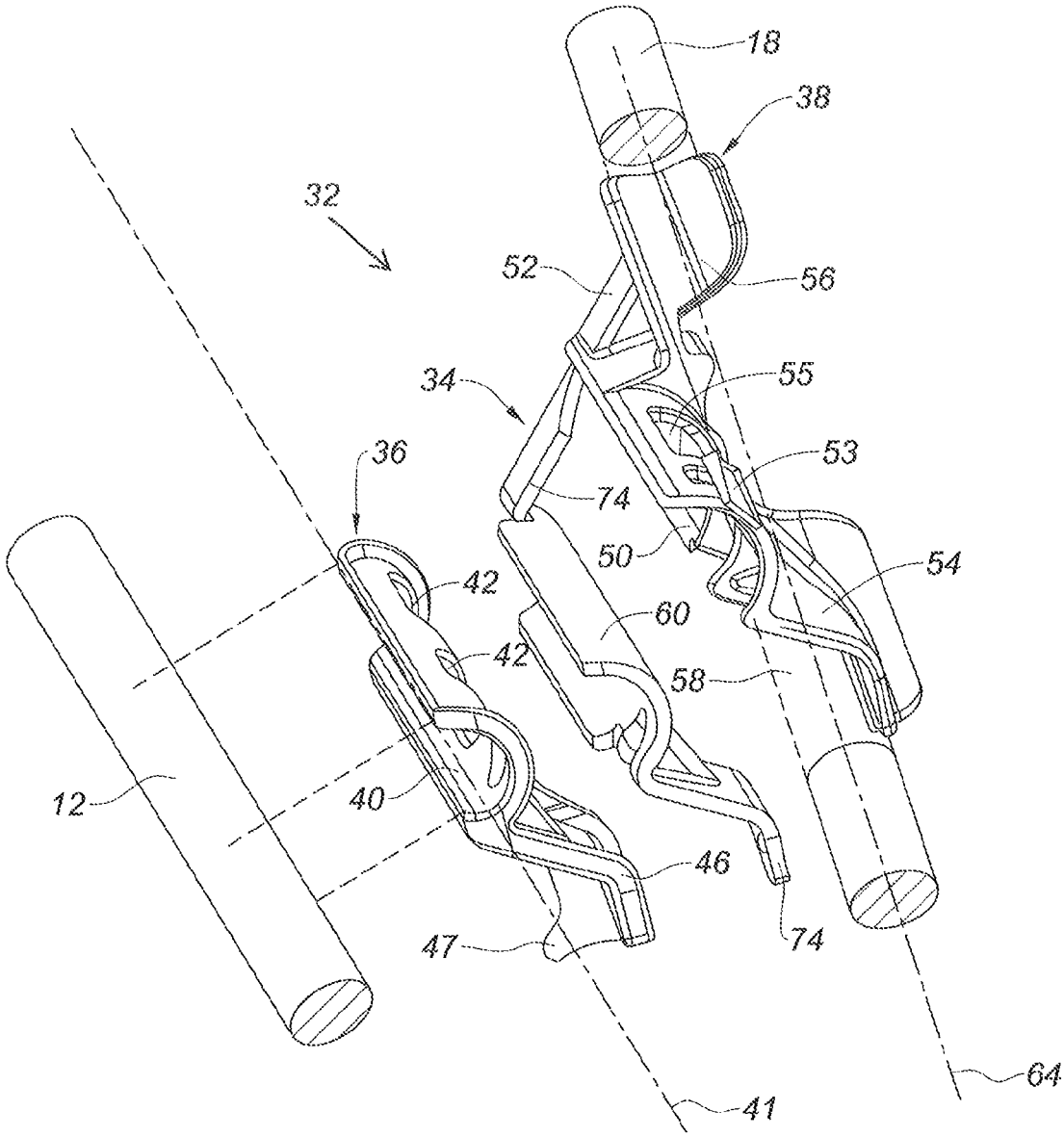
FIG. 5 is a second exploded perspective view of the part of FIG. 4.

In the rest of this description, only the part 32 is described in detail in reference to FIGS. 4 and 5.

The part 32 is made up of a metal framework 34 on which two half-shells 36 and 38 are mounted made from a plastic material surrounding the framework 34. In the example, the half-shells 36 and 38 are made from impact-modified polyamide-6. The half-shells 36, 38 are assembled here on the framework 34 using a rivet (not shown).

The half-shell 36 is turned toward the tube 12. This half-shell 36 includes a groove 40, in the shape of a segment with a cylindrical surface, receiving the tube 12 with no degree of freedom. The curve radius of the groove 40 is substantially equal to the curve radius of the tube 12. In the illustrated example, the annular portion covered by the groove 40 is substantially equal to 180°. The groove 40 extends along an axis 41.

The groove 40 is provided with windows 42 emerging in its bottom. An orifice 44 for the passage of the hinge pin 23 also emerges in the bottom of the groove 40 in the central zone thereof.

The half-shell 36 also comprises a wing 46 extending substantially radially to the groove 40. On this wing 46, a half-cradle 47 in the form of a segment with a cylindrical surface is mounted. The annular portion covered by the walls of the half-cradle 47 is substantially equal to 80°.

The half-shell 38 is turned toward the tube 18. This half-shell 38 comprises a groove 50 in the form of a segment with a cylindrical surface. An orifice 51 for the passage of the hinge pin 23 emerges in the bottom of the groove 50.

The half-shell 38 also comprises two wings 52 and 54 extending substantially radially to the groove 50 in two opposite directions. A cradle 56 and a half-cradle 58 are respectively mounted on the wings 52 and 54.

The cradle 56 is in the form of a segment with a cylindrical surface. The angular portion covered by the walls of the cradle 56 is substantially equal to 160°. The half-cradle 58 is also in the form of a segment with a cylindrical surface. The angular portion covered by the walls of the half-cradle 58 is substantially equal to 80°.

Figure 6:
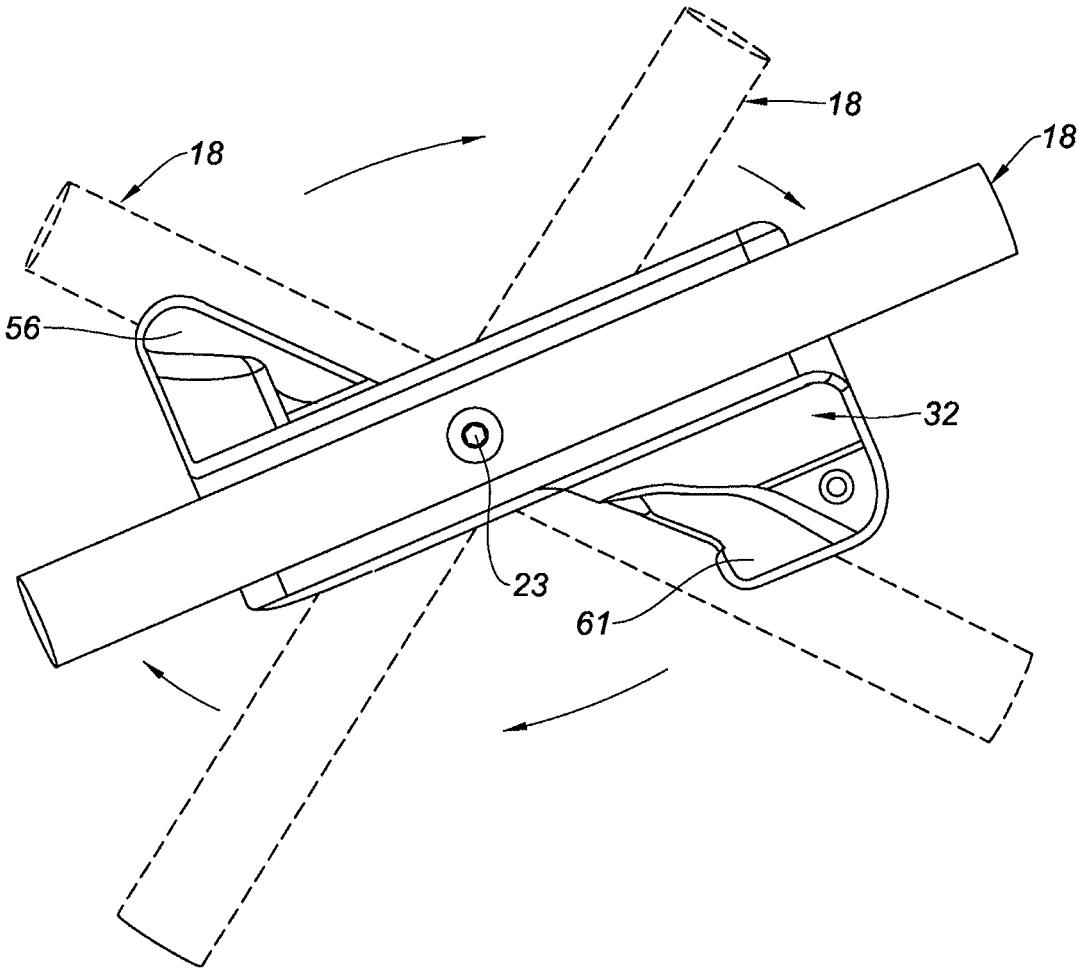
FIG. 6 is a partial view of the part of FIG. 4 in the folded position of the chair.

Advantageously, the half-shell 38 comprises an elastically deformable tongue 53. The tongue 53 is designed, when the chair 1 is in the folded position, to cooperate with the tube 18 so as to lock the chair 1 in the folded position thereof, as illustrated in FIG. 6.

The half-shell 38 is lastly provided with windows 55 leaving the framework 34 visible when the part 32 is assembled.

The metal framework 34 comprises a segment with a cylindrical surface 60 extending parallel to the grooves 40 and 50. An orifice 62 emerges in the bottom of that segment 60. This orifice 62 is positioned across from the orifices 44 and 51. The framework 34 comprises reinforcing tabs 74 extending toward the cradles. One of these tabs 74 is designed to be received in a recess formed in the wing 52.

Figure 3:
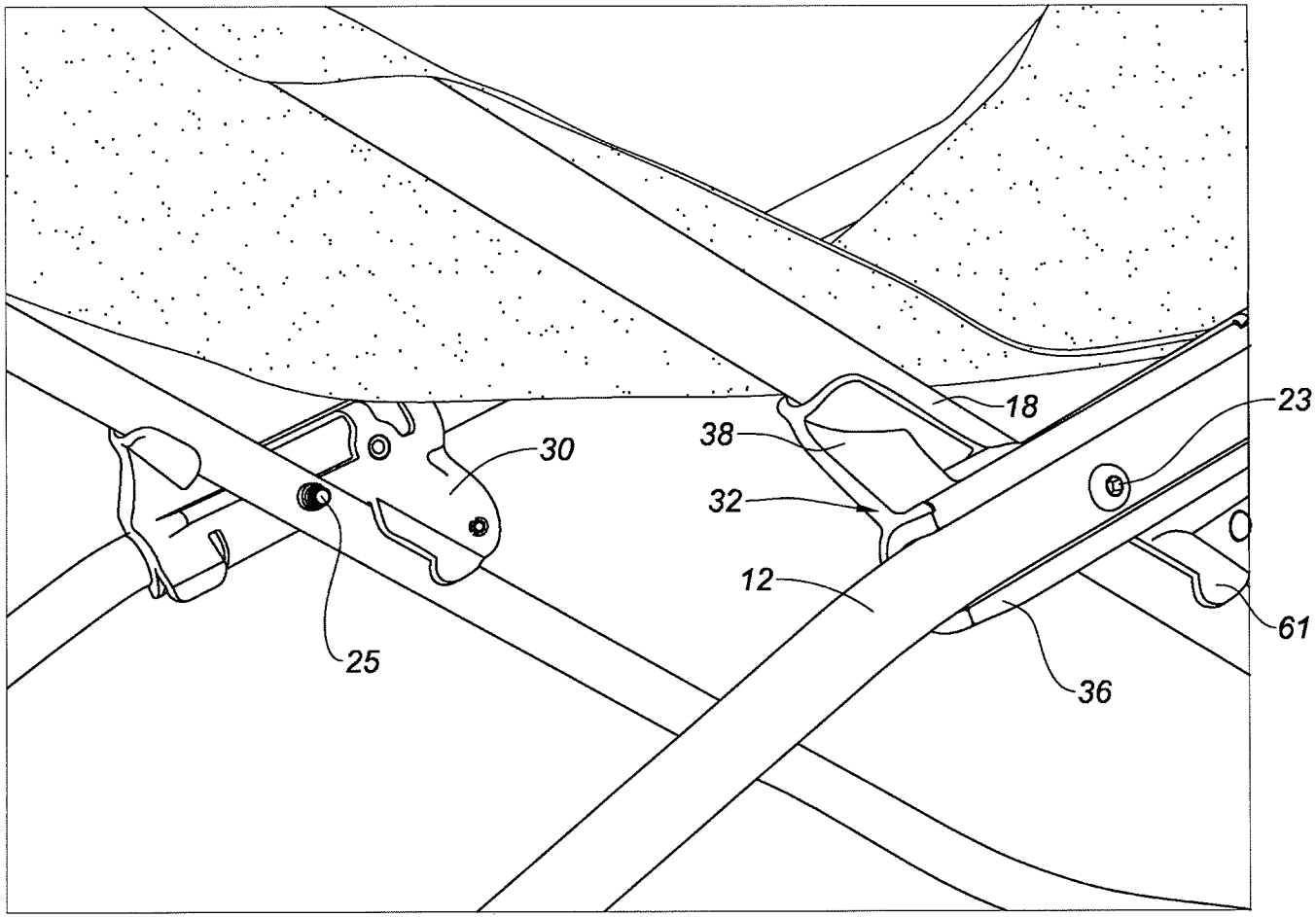
FIG. 3 is a partial perspective enlarged view, in the hinge area of the tubes in the unfolded position.

When the part 32 is assembled, the half-cradles 47 and 58 are alongside one another to form a cradle 61 (visible in FIG. 3). The cradles 56 and 61 are positioned separated from each other on either side of the hinge pin. The cradle 56 is turned upward, and the cradle 61 is turned downward.

The cradles 56 and 61 have the same curve radius. The cradles 56 and 60 extend along the same axis 64. The axis 64 forms an angle with the axis 41 of the groove 40. As an example, this angle here is substantially equal to 40°.

At least one part of the walls of the cradle 61 preferably extends over more than half of the circumference of the tube 10.

The part 30 is not described. This part 30 is obtained symmetrically with respect to the part 32 in reference to a plane of symmetry of the chair 1, substantially parallel to the tubes 10, 12, 18 and 20.

The operating principle of the chair 1 will now be described.

Figure 2:
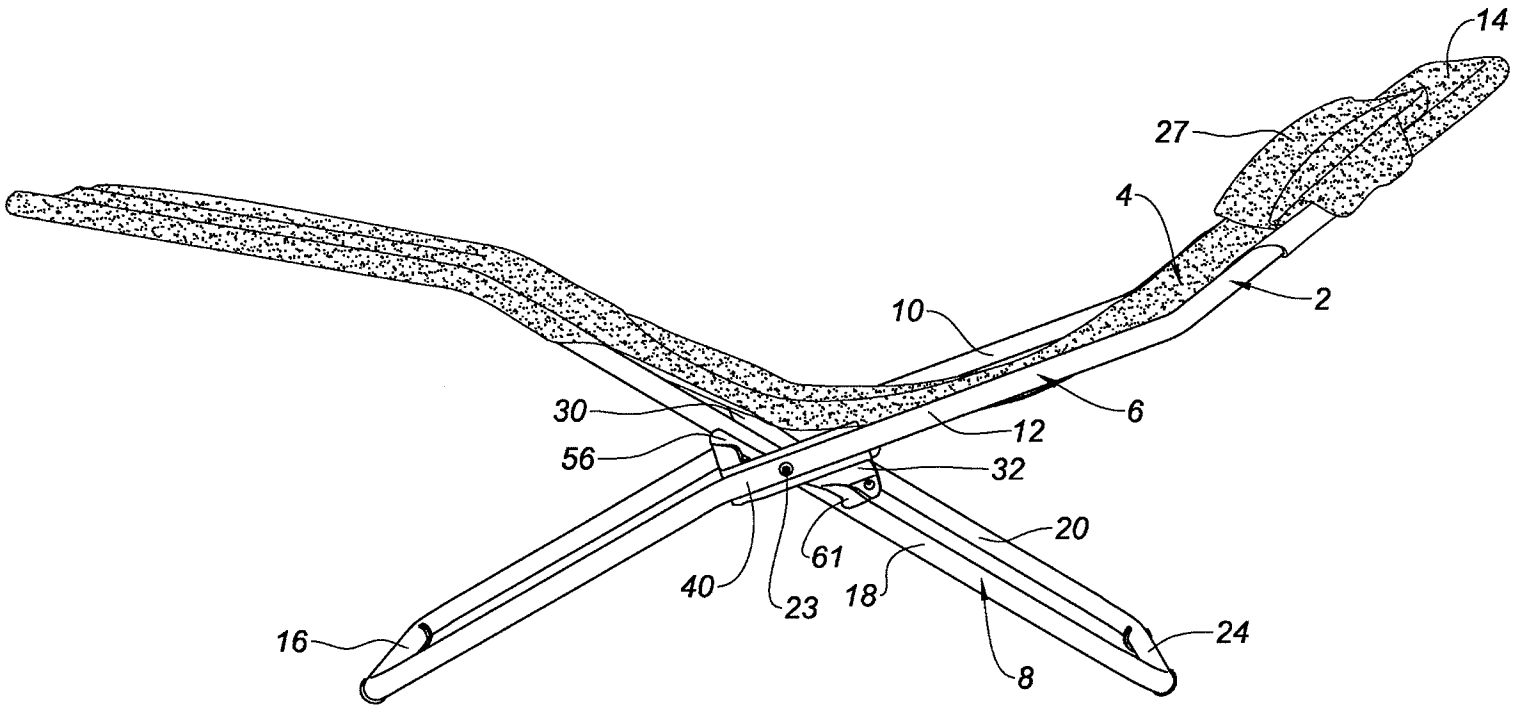
FIG. 2 is a side view in the unfolded position.

When the chair 1 is in the unfolded position (illustrated in FIGS. 1 to 3), the frames 6 and 8 intersect while forming an X. More particularly, at the part 32, the cradle 56 bears against the upper tube segment 10*a*, and the cradle 61 bears against the lower tube segment 10*b*.

The walls of the cradle 61 extend over more than half of the circumference of the tube 10, said walls of the cradle 61 deform elastically during engagement of the tube 10, and the segment 10*b* clips to the inside of the cradle 61. Thus, the chair 1 is locked in the unfolded position.

When the chair 1 is moved toward its folded position (partially illustrated in FIG. 6), the frame 6 pivots on the frame 8 such that the transverse tubes 14 and 22 are across from each other. More specifically, the tube 18 pivots around the axis 23 until the tube 18 extends substantially parallel to the tube 12. Under these conditions, the tube 18 deforms the tongue 53, which in response locks the tube 18 in that position, and thus the chair 1 in its folded position.

The embodiment of the invention described above is not limiting. Improvements may be made in alternative embodiments without going beyond the scope of the invention.

The invention claimed is:

1. A folding chair, which can be maneuvered between a folded position and an unfolded position, including:

a tubular structure formed from a first unit and a second unit, each of the first unit and the second unit comprising first and second tubes, the first unit and the second unit being hinged on one another by a hinge pin, each of the first and second tubes of the first unit and each of the first and second tubes of the second unit comprising an upper segment and a lower segment, the upper segments of the first tubes of the first unit and the second unit forming a seat back and the lower segments of the first tubes of the first unit and the second unit forming a front leg assembly, the upper segments of the second tubes of the first unit and the second unit forming a seat bottom and the lower segments of the second tubes of the first unit and the second unit forming a rear leg assembly, a canvas comprising a first end mounted on the upper segments of the first tubes of the first unit and the second unit, and a second end mounted on the upper segments of the second tubes of the first unit and the second unit, wherein each assembly of the first tubes and each assembly of the second tubes comprises a rigid part at the hinge pin thereof, said rigid part being arranged between the first tubes and second tubes, and having:

a groove in the shape of a segment with a cylindrical surface designed to receive, with no degree of freedom, one of the tubes of the assembly of the first tubes, an orifice for the passage of the hinge pin emerging in the bottom of the groove of the central zone thereof, first and second cradles in the form of segments with cylindrical surfaces with the same axis and same curve radius, positioned separated from each other on either side of the hinge pin, the axis of the first and second cradles forming an angle with the axis of the groove, the first cradle being turned upward, and the second cradle being turned downward, such that when the chair is in the unfolded position:

the first cradle bears against the upper segment of the other tube of the assembly of the first tubes, and the second cradle bears against the lower segment of the other tube of the assembly of the first tubes.

2. The chair according to claim 1, wherein walls of at least one cradle extend over more than half of the circumference one of the tubes that it is designed to receive and in that the cradle is made from an elastically deformable material, such that in the unfolded position, the tube clips inside said cradle.

3. The chair according to claim 2, wherein each part positioned at a hinge of the assembly of the first tubes or the assembly of the second tubes comprises an elastically deformable tongue designed, when the chair is in the folded position, to cooperate with the other tube against which the cradles bear in the unfolded position, so as to lock the folding chair in its unfolded position.

4. The chair according to claim 2, wherein each part positioned at a hinge of the assembly of the first tubes or the assembly of the second tubes comprises a metal framework on which two half-shells made from a plastic material are mounted.

5. The chair according to claim 1, wherein each part positioned at a hinge of the assembly of the first tubes or the assembly of the second tubes comprises an elastically deformable tongue designed, when the chair is in the folded position, to cooperate with the other tube against which the cradles bear in the unfolded position, so as to lock the folding chair in its unfolded position.

6. The chair according to claim 5, wherein each part positioned at a hinge of the assembly of the first tubes or the assembly of the second tubes comprises a metal framework on which two half-shells made from a plastic material are mounted.

7. The chair according to claim 1, wherein each part positioned at a hinge of the assembly of the first tubes or the assembly of the second tubes comprises a metal framework on which two half-shells made from a plastic material are mounted.

8. The chair according to claim 7, wherein the metal framework comprises a segment with a cylindrical surface extending parallel to the groove from which reinforcing tabs extend toward the first and second cradles.

9. The chair according to claim 8, wherein at least one of the half-shells is equipped with a window leaving the metal framework visible.

* * * * *